US007343977B2

(12) United States Patent
Martin et al.

(10) Patent No.: US 7,343,977 B2
(45) Date of Patent: Mar. 18, 2008

(54) TRANSLATING DOWNHOLE TOOL

(75) Inventors: David Glen Martin, Aberdeen (GB); Richard Michael Gledhill, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 253 days.

(21) Appl. No.: 11/021,121

(22) Filed: Dec. 22, 2004

(65) Prior Publication Data

US 2005/0139357 A1 Jun. 30, 2005

(30) Foreign Application Priority Data

Dec. 27, 2003 (GB) ..... 0330070.4

(51) Int. Cl.
*E21B 31/00* (2006.01)

(52) U.S. Cl. ..... 166/301; 166/178

(58) Field of Classification Search ..... 166/301, 166/178

See application file for complete search history.

(56) References Cited

U.S. PATENT DOCUMENTS 4,545,434 A 10/1985 Higgins
6,345,669 B1 * 2/2002 Buyers et al. ..... 166/381

OTHER PUBLICATIONS

Great Britain Search Report from GB Application No. GB 0330070.4 dated Mar. 15, 2004.

* cited by examiner

*Primary Examiner*—David Bagnell
*Assistant Examiner*—Brad Harcourt
(74) *Attorney, Agent, or Firm*—Patterson & Sheridan, L.L.P.

(57) ABSTRACT

A tool for generating a force downhole comprises a body, a longitudinally movable activating member mounted to the body, and a longitudinally movable driven member also mounted to the body. The driven member is operatively associated with the activating member such that on translation of the activating member in one axial direction, the driven member is translated in an opposite axial direction. The tool may be utilised to convert a pulling action, applied by a spoolable member, to a pushing action, useful in disengaging a downhole lock.

20 Claims, 4 Drawing Sheets

TRANSLATING DOWNHOLE TOOL

CROSS-REFERENCE TO RELATED APPLICATIONS

This application claims benefit of Great Britain patent application serial number GB 0330070.4, filed on Dec. 27, 2003, which is herein incorporated by reference.

BACKGROUND OF THE INVENTION

1. Field of the Invention

The present invention relates to a downhole tool. In particular, but not exclusively, the present invention relates to a tool for generating a force downhole and to a method of generating a force downhole.

2. Description of the Related Art

As is well known in the oil and gas exploration and production industry, access to subterranean hydrocarbon bearing formations is achieved by drilling a borehole to a desired depth and casing\lining the borehole with tubing. Strings of smaller diameter tubing and downhole tools are often located within the casing\liner for performing desired downhole functions. These tubing strings and tools may require to be fixed relative to the casing\liner, and this is typically achieved using dedicated downhole locks, which may include locking dogs that are radially movable to engage a recess in a wall of the casing\liner.

Downhole tools or tubing strings including such locks are typically run into the casing\liner with the locking dogs in a retracted position, to allow passage of the string through the tubing. Once the string has been located in the desired position, the lock is activated to engage the locking dogs in the recess. Examples of existing locks include the Otis Engineering lock, commercially available under the X-LINE trade mark, and the Baker Oil Tools lock, commercially available under the SUR-SET trade mark. These locks are of a "jar up to release" type, where a force is exerted on the lock, via a fishing neck, in an upward direction (along the borehole towards the surface) to release the lock.

Locks of this type suffer from the disadvantage that the direction of release of the lock is the same as the direction of flow of well fluids through the borehole. Accordingly, it has been found that there is a tendency for the fishing neck to vibrate and creep upwardly, especially in a severe or heavy flow situation, which can cause premature release.

Alternative locks are of a "jar down to release" type where a force is exerted in a downward direction to release the lock. In locks of this type, flow of well fluids does not cause premature release and in fact tends to further energise the lock, and these locks are often selected for this reason. One such lock is commercially available from the applicant under the UNISET QX trade mark.

However, it is generally preferred to exert an upward jarring force to release a lock in the downhole environment, for reasons including that it is safer to exert a large force by jarring up compared to jarring down and, furthermore, an upward jarring can be performed using wireline\slickline. As is known in the art, wireline\slickline offers advantages in terms of speed of tool\tubing deployment and recovery.

It is among the objects of embodiments of the present invention to obviate or mitigate at least one of the foregoing disadvantages.

SUMMARY OF THE INVENTION

According to a first aspect of the present invention, there is provided a tool for generating a force downhole, the tool comprising:

a longitudinally movable activating member, and a longitudinally movable driven member operatively associated with the activating member such that on translation of the activating member in one axial direction, the driven member is translated in an opposite axial direction.

The invention therefore provides a tool where movement of the activating member in one direction can be used to generate a movement of the driven member in an opposite direction. Thus by coupling the downhole tool to, for example, a downhole component, a downward movement of the component or part of the component can be generated by applying an upwardly directed force on the activating member, or vice-versa. It will be understood that references herein to upward and downward directions are made relative to a borehole in which the downhole tool is to be located, upward referring to a direction along the borehole towards an upper end of the borehole and downward to a direction along the borehole towards a lower or deeper end of the borehole.

Preferably, the downhole tool is adapted to be located and suspended in a borehole on a wireline or slickline. As is well known in the art, wireline\slickline offers advantages in the speed of tool deployment and recovery. Where it is desired to exert an upwardly directed force on the activating member, it may be preferred to deploy the tool on wireline\slickline, as this is suitable for exerting an upwardly directed force, and allows relatively quick deployment\recovery of the tool compared to other methods. Alternatively, the downhole tool may be adapted to be located and suspended in a borehole on coiled tubing or the like. Coiled tubing also offers advantages in speed of tool deployment and recovery when compared to conventional sectional tubing, and where it is desired to exert a downwardly directed force on the activating member it may be preferred to deploy the tool on coiled tubing.

Preferably also, the activating member is adapted to be translated in an upward direction corresponding to said one axial direction to thereby translate the driven member in a downward direction corresponding to said opposite axial direction. Thus the activating member may be adapted to be translated on exertion of a pulling force on the activating member, to generate a pushing force on the driven member. The tool may thus have a particular utility for releasing a downhole lock of the type which is released by a downward movement, as the tool allows this action to be achieved through an upward jarring, with the advantages discussed above. Alternatively, the activating member may be adapted to be translated in a downward direction corresponding said one axial direction, to thereby translate the driven member in an upward direction corresponding to said opposite axial direction. Thus the activating member may be adapted to be translated on exertion of a pushing force on the activating member, to generate a pulling force on the driven member.

The activating member may be movable in a first direction corresponding to said one axial direction and a second direction corresponding to said opposite axial direction, to cause a corresponding movement of the driven member in the second and the first axial directions, respectively. Alternatively, the activating member may be operatively associated with the driven member such that on translation of the activating member in said one axial direction, the driven member is translated in the opposite direction, and on translation of the activating member in said opposite direction, the driven member remains axially stationary. Thus repeated movements of the activating member in said one axial direction and then said opposite axial direction may facilitate successive translations of the driven member in said opposite direction, to progressively translate the driven member to a desired position. The tool may thus be arranged to selectively translate the driven member in response to translation of the activating member only in a selected axial direction. The tool may further comprise a mechanism for allowing selective translation of the driven member.

The tool may be movable between retracted and extended positions and may be adapted to be located in a borehole in a selected one of said positions, for subsequent movement towards the other one of said positions downhole. Where the activating member is adapted to be translated in an upward direction, the tool may be adapted to be located in a borehole in the retracted position. Where the activating member is adapted to be translated in a downward direction, the tool may be adapted to be located in a borehole in the extended position. The activating member and the driven member may each be movable between retracted and extended positions to define said corresponding positions of the tool.

Preferably, the tool further comprises a rotary member by which the activating member may be operatively associated with the driven member. The rotary member may be coupled to the activating member and adapted to be rotated on translation of the activating member in at least one axial direction. The rotary member may also be coupled to the driven member, and may be adapted to translate the driven member in an opposite axial direction on rotation. Thus translation of the activating member may rotate the rotary member, to thereby translate the driven member.

The tool may further comprise a clutch for selectively transferring rotation of the rotary member to the driven member, to selectively translate the driven member.

The rotary member may take the form of a threaded member such as a threaded shaft or screw, translation of the activating member rotating the threaded member about an axis thereof, which axis may be substantially parallel to axes of one or both of the activating and driven members. The threaded member may comprise first and second sets of threads or threaded portions of opposite hand (rotational orientation), one of the first and second threads associated with the activating member and the other with the driven member. This may facilitate translation of the driven member in an opposite direction to the activating member when the rotary member is rotated by the activating member.

Alternatively, the rotary member may be arranged for rotation about an axis substantially perpendicular to axes of one or both of the activating and driven members, and may take the form of a wheel, roller, drum, arm, plate or the like which may be located between and coupled to the activating and driven members.

Alternatively, the activating member may be operatively associated with the driven member by fluidly coupling the activating member to the driven member. The tool may further comprise a piston assembly by which the activating member may be fluidly coupled to the activating member. The piston assembly may comprise an activating piston coupled to the activating member and a driven piston coupled to the driven member. The activating and driven pistons may be fluidly coupled and may be arranged such that translation of the activating member is adapted to translate the activating piston, thereby supplying fluid to the driven piston to translate the driven piston and thus translate the driven member. The piston assembly may be arranged to evacuate fluid from an activating piston cylinder on translation of the activating member in said one direction and to direct said evacuated fluid into a driven piston cylinder to translate the driven member in said opposite direction.

The tool may be arranged to provide a mechanical advantage in the movement of the driven member relative to the activating member. Thus the tool may be arranged to generate a force on the driven member greater than a force applied on the activating member, which, in one embodiment, may be achieved by arranging the driven member to be translated a smaller axial distance than the activating member, or vice-versa. The tool may be arranged to generate a force on the driven member in a ratio of 2:1, 3:1, 4:1 or greater relative to the force exerted on the activating member. The driven member may therefore be geared relative to the activating member.

The tool may further comprise at least one, preferably a plurality of drive transfer members for transferring drive between the activating member and the driven member. Where the tool comprises a rotary member, the tool may further comprise at least one drive transfer member for transferring drive between the activating member and the rotary member, and at least one drive transfer member for transferring drive between the rotary member and the driven member. The drive transfer member may take the form of a ball, pin, key, tooth, dog, follower or the like. The drive transfer member may be fixed relative to the activating member and\or the driven member for movement therewith. Thus movement of the drive transfer member independently of the respective activating\driven member may be prevented.

Preferably, the activating member is restrained against rotation and may be restrained against rotation relative to a body of the tool in which the activating member is mounted. The activating member may be restrained against rotation by a locking member which may permit axial movement, but prevent rotation of the activating member. The locking member may comprise a tongue, latch, arm, leg, finger or other protrusion and may be coupled to the activating member and movable within a groove, slot, channel or the like in a body of the tool, or vice-versa. The driven member may similarly be restrained against rotation. Alternatively, the driven member may be adapted to be rotated and may be threaded such that rotation of the driven member is adapted to translate the driven member axially. The driven member may be adapted to be rotated by the rotary member.

According to a second aspect of the present invention, there is provided a tool for generating a force downhole, the tool comprising:

an activating member;

a rotary member coupled to the activating member and adapted to be rotated on translation of the activating member in at least one axial direction; and a driven member coupled to the rotary member and adapted to be translated in an opposite axial direction on rotation of the rotary member.

Accordingly, translation of the activating member causes a rotation of the rotary member, which in turn causes a translation of the driven member. Furthermore, exertion of a pull force on the activating member generates a push force on the driven member and vice-versa.

Further features of the tool are defined in relation to the first aspect of the invention.

According to a third aspect of the present invention, there is provided a method of generating a force downhole, the method comprising the steps of:

providing a downhole tool comprising a longitudinally movable activating member and a longitudinally movable driven member operatively associated with the activating member;

locating the tool downhole; and translating the activating member in one axial direction to thereby translate the driven member in an opposite axial direction.

The method may further comprise coupling the downhole tool to a wireline, slickline, coiled tubing or the like and running the downhole tool into a borehole before exerting a force on the activating member of the downhole tool through the wireline or the like.

The method may be a method of generating a downwardly directed force downhole, and may comprise exerting an upwardly directed force on the activating member. Through the operative association between the activating member and the driven member, a downwardly directed force may thereby be exerted on the driven member. Alternatively, the method may be a method of generating an upwardly directed force and may comprise exerting a downwardly directed force on the activating member to thereby exert an upwardly directed force on the driven member.

The method may be a method of generating a plurality of discrete downhole movements and this may be achieved by repeated translations of the activating member. Thus the activating member may be moved a number of times in a selected one axial direction, or may be moved in more than one axial direction. For example, the activating member may be moved in a first axial direction, to thereby translate the driven member in said opposite axial direction and may subsequently be moved in said opposite axial direction, to thereby translate the driven member in said one axial direction. Accordingly, the activating and driven members may be moved between a plurality of positions, and may, for example, be moved between retracted and extended positions, or vice-versa.

In one embodiment of the invention, the driven member may only be moved in response to translation of the activating member in a selected one axial direction. Furthermore, the plurality of movements of the activating member in said one axial direction may be carried out to progressively move the driven member towards a desired axial position.

Preferably the method further comprises operatively associating the activating member with the driven member by a rotary member, the method further comprising translating the activating member in said one axial direction to rotate the rotary member such that the rotary member translates the driven member in said opposite axial direction. This may be achieved by coupling the rotary member between the activating and driven members.

The method may further comprise translating the activating member a greater axial distance than the driven member, to generate a driving force on the driven member larger than a force exerted on the activating member. This may be achieved by gearing the driven member relative to the activating member.

According to a fourth aspect of the present invention, there is provided a method of generating a push force downhole in response to an applied pull force, the method comprising the steps of:

locating a downhole tool in a borehole;

restraining a body of the tool against movement;

exerting an axial pull on an activating member of the tool to translate the activating member relative to the tool body, rotating a rotary member of the tool; and exerting an axial push on a driven member of the tool to translate the driven member relative to the tool body.

The method may comprise operatively associating the activating member with the driven member such that translation of the activating member rotates the rotary member to thereby translate the driven member.

According to a fifth aspect of the present invention, there is provided a method of releasing a downhole lock, the method comprising the steps of:

coupling a downhole tool to the lock;

exerting an axial pull on an activating member of the tool to rotate a rotary member of the tool such that the rotary member exerts an axial push on a driven member of the tool; and arranging the driven member to transfer the axial push to the lock to release the lock.

The method may comprise arranging the driven member to transfer the axial push to part of the lock to translate said part and release the lock, and may comprise bringing the driven member into abutment and\or coupling the driven member to the lock\lock part.

BRIEF DESCRIPTION OF THE DRAWINGS

Embodiments of the invention will now be described, by way of example only, with reference to the accompanying drawings, in which.

DETAILED DESCRIPTION

Figure 1:
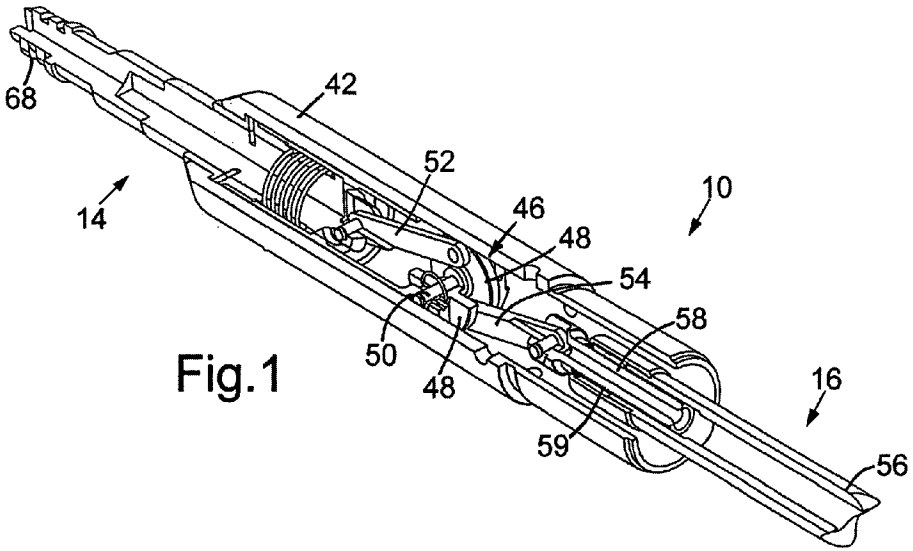
FIG. 1 is a perspective, partial sectional view of the downhole tool in accordance with an embodiment of the present invention, shown in a retracted, running-in position.

Referring firstly to FIG. 1, there is shown a perspective, partial sectional view of a downhole tool in accordance with an embodiment of the present invention, the tool shown in FIG. 1 in a retracted, running-in position and indicated generally by reference numeral 10.

Figure 2:
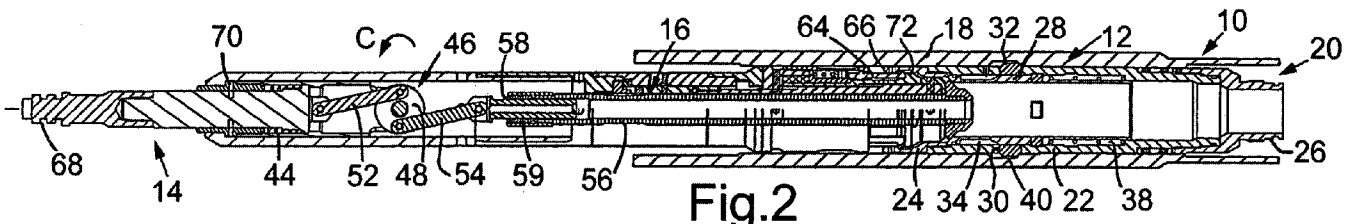
FIG. 2 is a longitudinal half-sectional view of the downhole tool of FIG. 1 shown located downhole engaged with a downhole component and in the retracted position of FIG. 1.

As will be described in more detailed below, the downhole tool 10 has a particular utility for releasing a downhole lock, such as a lock 12, which is shown in FIG. 2. In FIG. 2, the downhole tool 10 is shown in longitudinal half-section following engagement with the downhole lock 12, and is in the retracted, running-in position.

Figure 3:
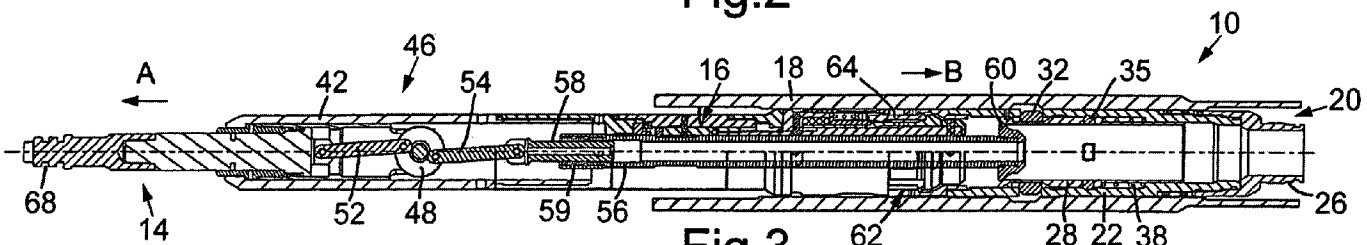
FIG. 3 is a view of the downhole tool of FIG. 1 following reference to an extended position.

The downhole tool 10 generally comprises an activating member 14 and a driven member 16 operatively associated with the activating member 14 such that on translation of the activating member 14 in one axial direction (indicated by the arrow A), the driven member 16 is translated in an opposite axial direction (indicated by the arrow B), to release the lock 12 as shown in FIG. 3. The activating member 14 and the driven member 16 are thus moved between retracted positions (FIGS. 12) and extended positions (FIG. 3), to release the lock 12.

The downhole lock 12 is shown in FIG. 2 located and locked within a section of downhole tubing 18, which may comprise a section of casing, liner, production tubing or the like. The lock 12 is itself provided at the upper end of a string of tubing or a tool string 15, shown in the schematic view of FIG. 3A, and serves for locating and suspending the string within the tubing 18.

In brief, the downhole lock 12 includes a body 22 with a fish-neck sleeve 24 connected to an upper end of the body 22, and a connecting sub 26 coupled to a lower end 20 of the body 22. An inner mandrel 28 is mounted within the body 22 for axial movement between the lock position (FIG. 2), and a release position (FIG. 3).

The body 22 includes a number of ports 30 in which locking dogs 32 are radially movably mounted, and the mandrel 28 includes a recessed portion 34 and a shoulder portion 36, and is run into and located within the casing 18 in the release position of FIG. 3. In this position, the inner mandrel 28 is held downwardly by mandrel locking dogs 35, compressing a return spring 38, and the locking dogs 32 are radially retracted in the mandrel recessed portion 34.

The lock 12 is activated by releasing the inner mandrel 28 and de-supporting the mandrel dogs 35, such that the mandrel 28 is moved to an upper position (FIG. 2) by the spring 38. The mandrel shoulder portion 36 then urges the dogs 32 radially outwardly to engage a recess 40 in a wall of the casing 12, locking the string to the tubing 18.

Considering the downhole tool 10 in more detail, the activating member 14 is mounted for axial movement within a body 42 of the tool and is biased towards a retracted position (FIG. 2) by a spring 44. The tool 10 also includes a rotary member 46 coupled to the activating member 14 and the driven member 16. In the illustrated embodiment, the rotary member 46 takes the form of a wheel or drum having two flanges 48, and is mounted on a shaft 50 for rotation about an axis perpendicular to a main axis of the tool 10.

The activating member 14 is connected to the drum 46 between the flanges 48 at an off-centre location by a connecting arm 52, and a similar arm 54 connects the driven member 16 to the drum 46 at a location spaced 180 degrees from the connection point of the arm 52.

The driven member 16 takes the form of a pusher including a hollow shaft 56 which is coupled to the connecting arm 54 by a threaded bolt 58, and the shaft 56 carries an activating collar 60 at a lower end.

The tool 10 also includes a fishing assembly 62 having a number of resilient fingers 64 that engage a fish-neck 66 on the fish-neck sleeve 24, as shown in FIGS. 2 and 3. The fingers 62 are located around a locking mandrel 72, which is moved to support the fingers 62 to couple the tool 10 to the lock 12, as will be described below.

The method of connecting the downhole tool 10 to the lock 12 and subsequently releasing the lock 12 will now be described.

Figure 3A:
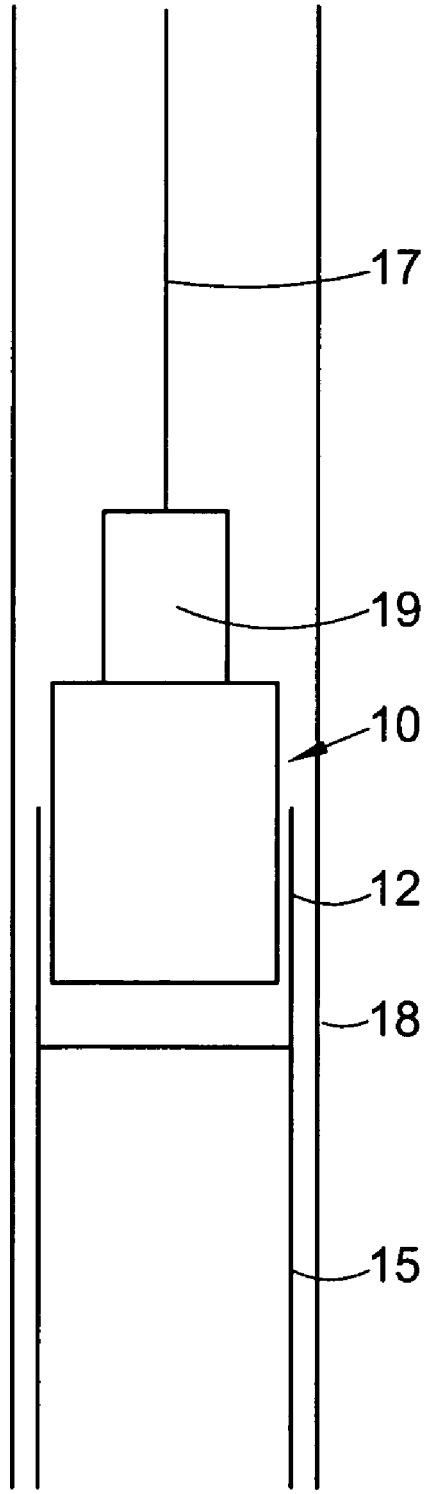
FIG. 3A is a schematic view of the downhole tool in use, showing a wireline and a jar coupled to the tool.

The downhole tool 10 is run into the borehole on a wireline 17 shown in FIG. 3A (or alternatively slickline, coiled tubing or the like) which is coupled to a jar 19, the jar 19 coupled to the activating member 14 by a cross-over 68. As is known in the art, a jar is used to generate a relatively large force in a downhole environment. A jar, such as the jar 19, is typically hydraulic, and is "set" by a number of separate activating forces exerted on the jar, such as through the wireline 17. When sufficient force is stored in the jar 19, the jar releases, exerting a large force in the tool 10. However, it will be understood that the tool 10 may be activated without the need for a jar, for example, by direct activation through the wireline 17.

In the running position of FIG. 1, the activating member 14 is held against axial movement relative to the body 42 by shear pins 70. The tool 10 is brought into engagement with the lock 12 by snapping the fingers 64 into the fish-neck 66 and then moving the locking mandrel 71 to support the fingers 64. A pulling force is then exerted on the connector 68 through the jar 19 to shear the pins 70 and translate the activating member 14 upwardly, compressing the spring 44.

This movement causes the connecting arm 52 to rotate the drum 46 in the direction of the arrow C (FIG. 2). This rotation causes the drum 46 to exert a pushing force on the connecting arm 54 and thus on the bolt 58 and hollow shaft 56. A ratchet mechanism 59 between the bolt 58 and the shaft 56 facilitates translation of the shaft 56 downwardly (to the right in the Figures), to translate the activating collar 60 from the position of FIG. 2 towards the position of FIG. 3. The ratchet 59 permits the desired movement of the shaft 56 to be achieved progressively, as the ratchet mechanism 59 prevents return movement of the shaft 56 upwardly (to the left in the Figures) when the crossover 68 is released and the spring 44 urges the bolt 58 back to the position of FIG. 2. Thus a number of cycles of movement of the bolt 58 is required to release the lock.

Movement of the shaft 56 to the FIG. 3 position carries the lock inner mandrel 28 downwardly, compressing the spring 38 and de-supporting the locking dogs 32. The locking dogs 32 can thus be disengaged from the recess 40 by upward movement of the lock 12, and the lock 12 can then be returned to surface.

It will therefore be understood that the downhole lock 12, which is of the type that is released in response to an applied downward force, can thus be released by application of an upwardly directed force by using the downhole tool 10.

Figure 4:
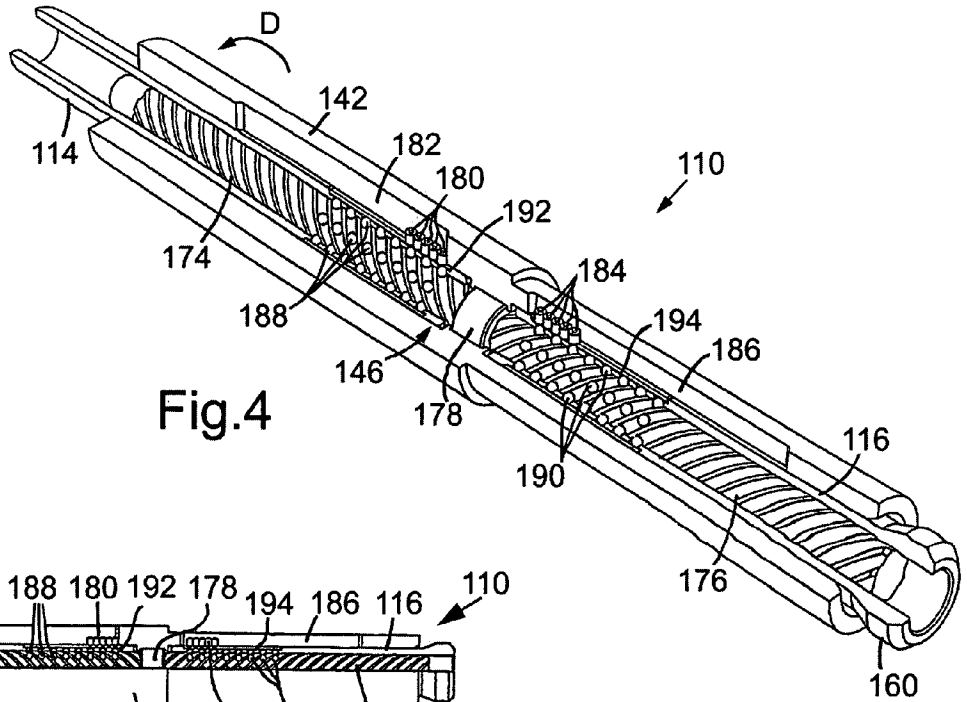
FIGS. 4 and 5 are partial sectional perspective and side views, respectively, of a downhole tool in accordance with an alternative embodiment of the present invention, shown in a retracted, running-n position.
Figure 5:
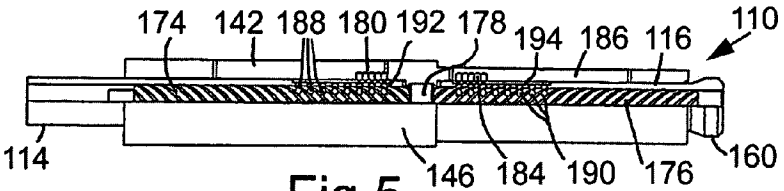

Turning now to FIGS. 4 and 5, there are shown partial sectional perspective and side views, respectively, of a downhole tool in accordance with an alternative embodiment of the present invention, the downhole tool indicated generally by reference numeral 110. The tool 110 is shown in FIGS. 4 and 5 in a retracted, running-in position corresponding to that of the tool 10 shown in FIGS. 1 and 2.

It will be understood that the tool 110 is suitable for releasing a lock such as the downhole lock 12 of FIGS. 2 and 3, and is connected to the lock in a similar fashion, but that the lock and other components have been omitted from the Figures, for ease of illustration. Furthermore, like components of the downhole tool 110 with the downhole tool 10 of FIGS. 1 to 3 share the same reference numerals, incremented by 100.

The downhole tool 110 includes an activating member in the form of a driver or sleeve 114, which is axially movably mounted in a body 142 of the tool. A driven member in the form of a pusher or sleeve 116 is also mounted for axial movement within the body 142, and a rotary member 146 is coupled to the driver 114 and pusher 116.

The rotary member 146 comprises a screw having threaded portions 174, 176 of opposite hand (rotational orientation), and is mounted for rotation within the body 142 by a bearing 178.

The driver 114 carries a number of roller bearings 180 which are movable within a groove 182 formed in the body 142. In this fashion, the activating sleeve 114 is axially movable with respect to the body 142, but is held against rotation. In a similar fashion, the pusher 116 carries a number of roller bearings 184 mounted for movement within a groove 186.

The tool 110 also includes a plurality of drive transfer members in the form of balls 188 and 190 for transferring drive between the driver 114 and the screw 146, and between the screw 146 and the pusher 116, respectively. Each ball 188, 190 is mounted within a respective aperture 192, 194 in the driver 114 and the pusher 116. In this way, the balls 188 and 190 are rotatable within their apertures 192, 194 and axially movable with the driver and pusher, respectively, but are captive and thus held against rotation around an inner circumference of the tool body 142.

Figure 6:
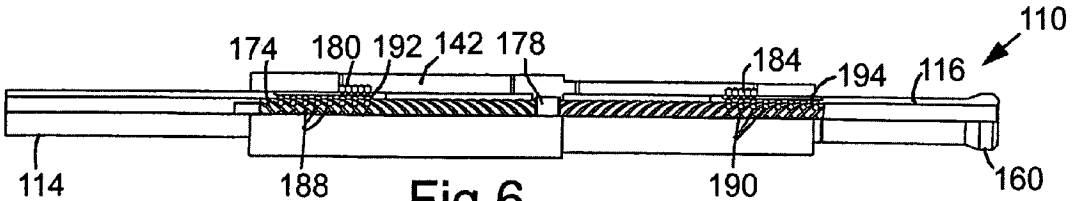
FIG. 6 is a view of the downhole tool of FIGS. 4 and 5 following movement to an extended position.

Following engagement with a lock, an upwardly directed pull force is exerted on the driver 114, translating the driver upwardly and carrying the bearings 180 within the groove 182. As the drive transfer balls 188 are held captive in the driver apertures 192, the balls 188 are translated with the driver 114, as shown in FIG. 6. This movement of the balls 188 imparts a rotation on the threaded portion 174 of the screw 146 in the direction of the arrow D (FIG. 4).

As the screw threaded portion 176 is of opposite hand to the portion 174, rotation of the screw 146 in the direction D imparts a downwardly directed force on the drive transfer balls 190. As the balls 190 are held captive in the pusher apertures 194, this movement carries the pusher 116 axially downwardly carrying the roller bearings 184 within the groove 186, to translate the balls 190 to the position of FIG. 6. This movement brings the tool 110 to the extended position with an activating collar 160 moving downwardly to release the lock.

Figure 7:
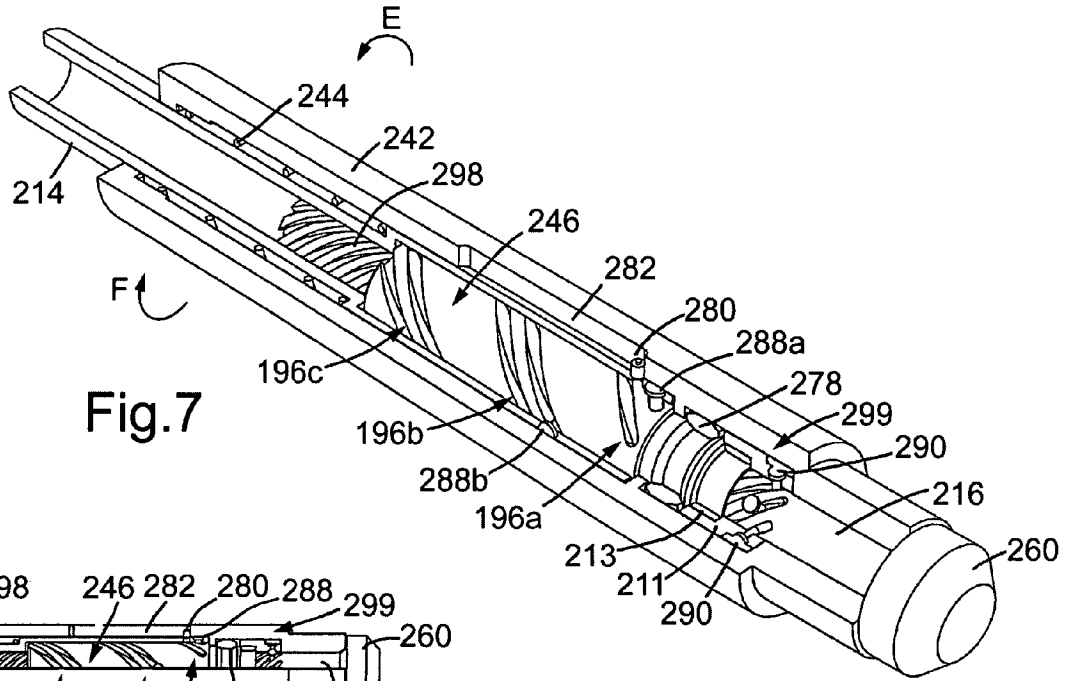
FIGS. 7 and 8 are partial sectional perspective and side views, respectively, of a downhole tool in accordance with an alternative embodiment of the present invention, shown in a retracted, running-in position.
Figure 8:
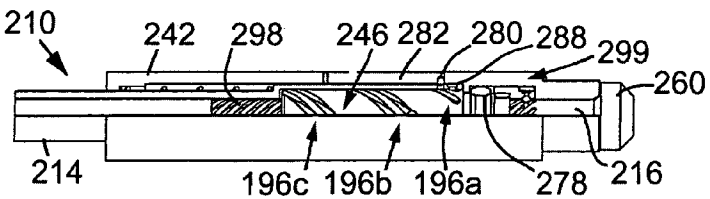

Turning now to FIGS. 7 and 8, there are shown partial sectional perspective and side views, respectively, of a downhole tool in accordance with a further alternative embodiment of the present invention. The downhole tool is indicated generally by reference numeral 210 and shown in FIGS. 7 and 8 in a retracted, running-in position.

Like components of the downhole tool 210 with the tool 10 of FIGS. 1 to 3 share the same reference numerals incremented by 200, and with the downhole tool 110 of FIGS. 4 to 6 incremented by 100.

The downhole tool 210 is again suitable for releasing a lock such as the lock 12 of FIGS. 2 and 3, but is shown without the lock and other components, for ease of illustration.

The downhole tool 210 includes an activating member in the form of a driver or sleeve 214 and a rotary member 246 in the form of a threaded shaft or driver screw having a series of axially spaced threads 196*a*, 196*b*, 196*c*. The driver 214 includes a roller bearing 280 mounted for movement in a groove 282, for restraining the driver 214 against rotation, and a number of drive transfer members in the form of captive driver pins 288 (two shown, 288*a*, 288*b*) associated with each set of threads 196*a*, 196*b* and 196*c*. The tool 210 also includes a driven member or pusher screw 216 which is threaded at 298 and is rotated and axially translated on movement of the driver 214, as will be described below.

The driver screw 246 is mounted in the tool body 242 by a bearing 278, and the tool includes a drive transfer assembly 299 comprising a rotatable drive transfer sleeve or pusher 211, and a number of drive transfer members in the form of pusher pins 290, which are mounted in apertures in the drive transfer sleeve 211. The driver screw 246 is coupled to the drive transfer sleeve 211 by a clutch 213, for selectively rotating the drive transfer sleeve 211 on translation of the driver 214.

The tool 210 is operated as follows. After engagement with a downhole lock, a pulling force is exerted on the driver 214. This translates the driver 214 upwardly carrying the driver pins, which thereby rotate the driver screw 246 through interaction with their respective threads 196.

The driver screw 246 is thus rotated in the direction of the arrow E, and through the clutch 213, rotates the drive transfer sleeve 211. This in turn rotates the captive driver pins 290, which translate the pusher 216 axially downwardly through their interaction with the threads 298.

The threads 196 and 298 are arranged such that there is a smaller axial translation of the pusher 216 relative to the driver 214, thereby providing a mechanical advantage in movement of the pusher 216 relative to the driver 214, in a ratio of 2:1, 3:1, 4:1 or greater. This ratio depends upon the relative geometry of the threads 196 on the driver screw 246 and the threads 298 on the pusher 216. Thus a relatively large movement of the driver 214 produces a relatively small movement of the pusher 216. However, the pulling force exerted on the driver 214 is smaller than the resultant pushing force which is generated and exerted on the pusher 216.

Figure 9:
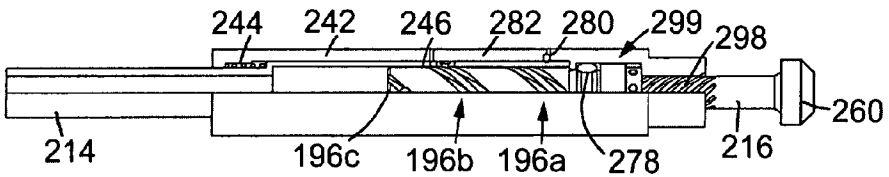
FIG. 9 is a view of the downhole tool of FIGS. 7 and 8 following movement to an extended position.

On movement of the tool 210 to the extended position of FIG. 9, the spring 244 is compressed and, when the pulling force on the driver 214 is released, the sleeve is returned to the retracted position of FIGS. 7 and 8.

This causes a corresponding rotation of the driver screw 246 in the direction of the arrow F. However, the clutch 213 is disengaged on rotation of the driver screw 246 in this direction, such that the rotation is not transmitted to the drive transfer sleeve 211. Accordingly, the pusher 216 is not rotated and remains axially stationary. On exerting a renewed pulling force on the driver 214, the pusher 216 is again translated axially downwardly a small distance, and repeated such movements of the driver 214 progressively move the pusher 216 towards an extended position, shown in FIG. 9.

Various modifications may be made to the foregoing within the scope of the present invention.

For example, the downhole tool may have other uses. In particular, the tool may be used for setting a downhole lock, that is, for locating and activating a lock. This may be achieved by, for example, operating the tool in reverse. Thus, either of the tools 10, 110 may be coupled to the lock 12 at surface with the tool in the extended position, and the tool and lock run into a borehole to a desired location. A pushing force may then be exerted on the respective activating member 14, 114 to thereby exert a pulling force on the driven member 16, 116. This may allow the lock inner mandrel 28 to move upwardly to the locking position of FIG. 2. It will be understood that the tool may equally be used to release the lock by reconnecting the tool to the lock and operating the tool as described above.

The tool 210 may equally be used to set a lock, by providing a clutch which transfers drive when the screw 246 is rotated in the opposite direction (F), following coupling of the tool to the lock in the extended position of FIG. 9. The clutch may be adapted to selectively transfer rotation to the drive transfer sleeve 211 in either direction, for example, by setting the clutch at surface or by providing a control signal to the tool from surface.

It will also be understood that the tool may have many further uses in the downhole environment, for releasing and or setting a number of different tools, or indeed for performing a range of downhole functions. In particular, the tool may have a use with any downhole tool, component or part thereof which is released, set\activated or actuated by a longitudinal movement, and may be used for operating valves; sliding sleeves; perforating guns; packers or the like.

The downhole tool may be adapted to be located and suspended in a borehole on coiled tubing or the like, which may be used to exert a downwardly or upwardly directed force. A downward force may be exerted through a wireline, if the tool is anchored relative to the borehole.

The rotary member may be arranged for rotation about any suitable axis or axes, and may take the form of a roller, arm, plate or the like.

The activating member may be operatively associated with the driven member by fluidly coupling the activating member to the driven member. The tool may further comprise a piston assembly by which the activating member may be fluidly coupled to the activating member. The piston assembly may comprise an activating piston coupled to the activating member and a driven piston coupled to the driven member. The activating and driven pistons may be fluidly coupled and may be arranged such that translation of the activating member is adapted to translate the activating piston, thereby supplying fluid to the driven piston to translate the driven piston and thus translate the driven member. The piston assembly may be arranged to evacuate fluid from an activating piston cylinder on translation of the activating member in said one direction and to direct said evacuated fluid into a driven piston cylinder to translate the driven member in said opposite direction.

The invention claimed is:

1. A tool for generating a force downhole, the tool comprising:

a body;

a longitudinally movable activating member mounted to the body; and a longitudinally movable driven member mounted to the body in axial opposition to the activating member and operatively associated with the activating member such that on translation of the activating member in one axial direction, the driven member is translated in an opposite axial direction, wherein the tool is arranged to provide a mechanical advantage in the movement of the driven member relative to the activating member.

2. A tool as claimed in claim 1, wherein the body is adapted for engaging a downhole device.

3. A tool as claimed in claim 1, wherein the driven member is adapted to engage and actuate a downhole device.

4. A tool as claimed in claim 1, wherein the body is adapted to be located in a borehole on a spoolable support member, and the activating member coupled to the support member.

5. A tool as claimed in claim 1, wherein the activating member is adapted to be translated on exertion of a pulling force thereon, to generate a pushing force on the driven member.

6. A tool as claimed in claim 1, wherein the tool is adapted to exert a force on a downhole lock to release the lock.

7. A tool as claimed in claim 1, wherein the tool is adapted to exert a force on a downhole lock to set the lock.

8. A tool as claimed in claim 1, wherein the activating member is operatively associated with the driven member such that on translation of the activating member in said one axial direction, the driven member is translated in the opposite direction, and on translation of the activating member in said opposite direction, the driven member remains axially stationary.

9. A tool as claimed in claim 1, wherein the tool further comprises a rotary member mounted to the body and the rotary member is coupled to the activating member and adapted to be rotated on translation of the activating member in at least one axial direction and wherein the rotary member is coupled to the driven member and adapted to translate the driven member in an opposite axial direction on rotation thereof.

10. A tool as claimed in claim 9, wherein the rotary member comprises a threaded member.

11. A tool as claimed in claim 9, wherein the rotary member is rotatable about a rotary member axis substantially perpendicular to axes of the activating and driven members.

12. A tool as claimed in claim 9, wherein the rotary member takes the form of a wheel located between and coupled to the activating and driven members.

13. A tool as claimed in claim 1, wherein the activating member is restrained against rotation relative to the body by a locking member which permits axial movement, but prevents rotation of the activating member.

14. A tool as claimed in claim 1, wherein the driven member is restrained against rotation relative to the body by a locking member which permits axial movement, but prevents rotation of the driven member.

15. A tool as claimed in claim 1, wherein the driven member is rotatable relative to the body.

16. A tool for generating a force downhole, the tool comprsing:

a body;

a longitudinally movable activating member mounted to the body; and a longitudinally movable driven member mounted to the body in axial opposition to the activating member and operatively associated with the activating member such that on translation of the activating member in one axial direction, the driven member is translated in an opposite axial direction, wherein the activating member is movable in a first direction corresponding to said one axial direction and a second direction corresponding to said opposite axial direction, to cause a corresponding movement of the driven member in the second and the first axial directions, respectively.

17. A tool for generating a force downhole, the tool comprising:

a body;

a longitudinally movable activating member mounted to the body;

a longitudinally movable driven member mounted to the body in axial opposition to the activating member and operatively associated with the activating member such that on translation of the activating member in one axial direction, the driven member is translated in an opposite axial direction;

a rotary member mounted to the body, wherein the rotary member is coupled to the activating member and adapted to be rotated on translation of the activating member in at least one axial direction and wherein the rotary member is coupled to the driven member and adapted to translate the driven member in an opposite axial direction on rotation thereof; and a clutch for selectively transferring rotation of the rotary member to the driven member, to selectively translate the driven member.

18. A tool for generating a force downhole, the tool comprising:

a body;

a longitudinally movable activating member mounted to the body;

a longitudinally movable driven member mounted to the body in axial opposition to the activating member and operatively associated with the activating member such that on translation of the activating member in one axial direction, the driven member is translated in an opposite axial direction; and a rotary member mounted to the body, wherein the rotary member is coupled to the activating member and adapted to be rotated on translation of the activating member in at least one axial direction and wherein the rotary member is coupled to the driven member and adapted to translate the driven member in an opposite axial direction on rotation thereof, wherein the rotary member is rotatable about a rotary member axis substantially parallel to axes of the activating and driven members.

19. A tool as claimed in claim 18, wherein the rotary member comprises first and second sets of threads of opposite hand.

20. A tool for generating a force downhole, the tool comprising:

a body;

a longitudinally movable activating member mounted to the body; and a longitudinally movable driven member mounted to the body in axial opposition to the activating member and operatively associated with the activating member such that on translation of the activating member in one axial direction, the driven member is translated in an opposite axial direction, wherein the driven member is rotatable relative to the body and threaded such that rotation of the driven member translates the driven member.

* * * * *